US009518468B2

(12) United States Patent
Tibbott et al.

(10) Patent No.: US 9,518,468 B2
(45) Date of Patent: Dec. 13, 2016

(54) COOLED COMPONENT FOR THE TURBINE OF A GAS TURBINE ENGINE

(75) Inventors: Ian Tibbott, Lichfield (GB); Dougal R. Jackson, Derby (GB)

(73) Assignee: ROLLS-ROYCE plc, London (GB)

( * ) Notice: Subject to any disclaimer, the term of this patent is extended or adjusted under 35 U.S.C. 154(b) by 873 days.

(21) Appl. No.: 13/359,180

(22) Filed: Jan. 26, 2012

(65) Prior Publication Data

US 2013/0343872 A1 Dec. 26, 2013

(30) Foreign Application Priority Data

Feb. 17, 2011 (GB) ..... 1102719.0

(51) Int. Cl.
*F01D 5/18* (2006.01)
*F01D 9/06* (2006.01)
*F01D 5/20* (2006.01)

(52) U.S. Cl.
CPC ..... *F01D 5/18* (2013.01); *F01D 5/186* (2013.01); *F01D 5/188* (2013.01); *F01D 5/20* (2013.01); *F01D 9/06* (2013.01); *F01D 9/065* (2013.01); *F05D 2240/81* (2013.01)

(58) Field of Classification Search
CPC ..... F01D 5/187; F01D 5/188; F01D 5/186; F01D 9/065; F01D 9/06
USPC ..... 415/115; 416/95, 96 R, 97 R
See application file for complete search history.

(56) References Cited

U.S. PATENT DOCUMENTS 4,604,031 A * 8/1986 Moss et al. ..... 416/97 R
5,073,086 A * 12/1991 Cooper ..... 416/96 R
5,403,157 A 4/1995 Moore
5,465,780 A * 11/1995 Muntner et al. ..... 164/516
5,545,002 A * 8/1996 Bourguignon et al. ..... 415/115
6,036,440 A * 3/2000 Tomita et al. ..... 416/96 R
6,234,753 B1 * 5/2001 Lee ..... 416/97 R
6,340,047 B1 * 1/2002 Frey ..... 164/137
6,595,750 B2 * 7/2003 Parneix et al. ..... 416/97 R
6,932,573 B2 8/2005 Liang
7,654,795 B2 * 2/2010 Tibbott ..... F01D 5/187 415/115

(Continued)

FOREIGN PATENT DOCUMENTS

EP 0 924 385 A2 6/1999
EP 1 055 800 A2 11/2000

(Continued)

OTHER PUBLICATIONS

British Search Report issued in Application No. 1102719.0; Dated May 20, 2011.

*Primary Examiner* — Christopher Verdier
(74) *Attorney, Agent, or Firm* — Oliff PLC

(57) ABSTRACT

A component for the turbine of a gas turbine engine is provided. The component two facing walls interconnected by one or more generally elongate divider members to partially define side-by-side, generally elongate, cooling fluid passage portions which form a multi-pass cooling passage within the component. The passage portions are connected in series fluid flow relationship by respective bends formed by joined ends of neighbouring of the passage portions. The component further includes one or more core tie linking passages formed in the divider members. One or more differential pressure reducing arrangements are formed in the multi-pass cooling passage adjacent respective of the core tie linking passages.

7 Claims, 9 Drawing Sheets

(56) References Cited

U.S. PATENT DOCUMENTS 7,780,414 B1 * 8/2010 Liang ..... 416/97 R

FOREIGN PATENT DOCUMENTS

| | | | |
|---|---|---|---|
| EP | 1 467 065 | A2 | 10/2004 |
| EP | 1 895 098 | A2 | 3/2008 |
| GB | 2 349 920 | A | 11/2000 |
| JP | A-2009-297765 | | 12/2009 |

* cited by examiner

COOLED COMPONENT FOR THE TURBINE OF A GAS TURBINE ENGINE

The present invention relates to a cooled component, such as an aerofoil blade or vane, for use in gas turbine engines.

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate-pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 14 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The performance of gas turbine engines, whether measured in terms of efficiency or specific output, is improved by increasing the turbine gas temperature. It is therefore desirable to operate the turbines at the highest possible temperatures. For any engine cycle compression ratio or bypass ratio, increasing the turbine entry gas temperature produces more specific thrust (e.g. engine thrust per unit of air mass flow). However as turbine entry temperatures increase, the life of an un-cooled turbine falls, necessitating the development of better materials and the introduction of internal air cooling.

In modern engines, the high-pressure turbine gas temperatures are hotter than the melting point of the material of the blades and vanes, necessitating internal air cooling of these airfoil components. During its passage through the engine, the mean temperature of the gas stream decreases as power is extracted. Therefore, the need to cool the static and rotary parts of the engine structure decreases as the gas moves from the high-pressure stage(s), through the intermediate-pressure and low-pressure stages, and towards the exit nozzle.

FIG. 2 shows an isometric view of a typical single stage cooled turbine. Cooling air flows are indicated by arrows.

Internal convection and external films are the prime methods of cooling the gas path components—airfoils, platforms, shrouds and shroud segments etc. High-pressure turbine nozzle guide vanes 31 (NGVs) consume the greatest amount of cooling air on high temperature engines. High-pressure blades 32 typically use about half of the NGV flow. The intermediate-pressure and low-pressure stages downstream of the HP turbine use progressively less cooling air.

The high-pressure turbine airfoils are cooled by using high pressure air from the compressor that has by-passed the combustor and is therefore relatively cool compared to the gas temperature. Typical cooling air temperatures are between 800 and 1000 K, while gas temperatures can be in excess of 2100 K.

The cooling air from the compressor that is used to cool the hot turbine components is not used fully to extract work from the turbine. Therefore, as extracting coolant flow has an adverse effect on the engine operating efficiency, it is important to use the cooling air effectively.

Ever increasing gas temperature levels combined with a drive towards flatter combustion radial profiles, in the interests of reduced combustor emissions, have resulted in an increase in local gas temperature experienced by the extremities of the blades and vanes, and the working gas annulus endwalls.

A turbine blade or vane has a longitudinally extending aerofoil portion with facing suction side and pressure side walls. These aerofoil portions extend across the working gas annulus, with the longitudinal direction of the aerofoil portion being along a radial direction of the engine. FIG. 3 shows a longitudinal cross-section through a high-pressure turbine blade. A multi-pass cooling passage 33 is fed cooling air by a feed passage 34 at the root of the blade. Cooling air eventually leaves the multi-pass cooling passage through exit holes at the tip 35 and the trailing edge 36 of the blade. Some of the cooling air, however, can leave the multi-pass cooling passage through effusion holes (not shown) formed in the suction side and pressure side walls. The block arrows in FIG. 3 show the general direction of cooling air flow.

The (triple) multi-pass cooling passage 33 is formed by two divider walls 37 which interconnect the facing suction side and pressure side walls of the aerofoil portion to form three longitudinally extending, side-by-side passage portions 38. Other aerofoil portions can have more or fewer divider walls and passage portions. The passage portions are connected in series fluid flow relationship by respective bends 39 which are formed by the joined ends of neighbouring passage portions. The cooling air thus enters the multi-pass cooling passage at the passage portion at the leading edge of the aerofoil portion and flows through each passage portion in turn to eventually leave from the passage portion at the trailing edge. Trip strip 40 and pedestal 41 heat transfer augmentation devices in the passage portions enhance heat transfer between the cooling air and the metal.

In FIG. 3, the labels P1 to P8 denote the local pressures at the feed passage 34 (P1), the trailing edge 36 (P8) and locations in the passage portions 38 (P2-P7). The pressure in general falls significantly from P1 to P8 due to bend losses and frictional losses associated with the heat transfer augmentation devices 40, 41. However, these pressure drops are modified by the centrifugal pumping effect experienced by the cooling air in rotor blades. Thus there is a pressure gain in outward flowing passages and an additional pressure loss in inward flowing passages.

The complicated internal structure of the aerofoil portion is generally formed by an investment casting procedure. Thus the mould for the aerofoil portion has a core structure which is a "negative" of the ultimate internal structure of the aerofoil portion. In particular, the mould has passage features corresponding to the longitudinally extending passage portions 38. These passage features are relatively fragile, and to provide strengthening and preserve wall thicknesses it is usually necessary to provide "core ties" which extend between the passage features. Typically, the core ties are positioned in the vicinity of the bends 39 and midway along the passage portions. In the final aerofoil portion, the core ties result in linking passages 42 which extend across the divider walls, each linking passage having an entrance in one passage portion and an exit in a neighbouring passage portion. The linking passages thus allow cooling air to leak across the divider walls, and the leaked cooling air short circuits the cooling scheme of the multi-pass cooling passage 33.

More particularly, the leakage flow that exits from the linking passages 42 disrupts the flow of air in the passage portions 38, causing it to slow down locally, changing the pressure losses, and reducing the local Reynolds number and internal heat transfer coefficient. Local dead spots can be created in the cooling air flow e.g. downstream of linking passage entrances and upstream of linking passage exits. Thus the linking passages can modify the flow distribution inside the cooling scheme and increase the amount of cooling air required to cool the aerofoil. This in turn increases aerodynamic losses, reduces engine efficiency and elevates engine specific fuel consumption. Therefore, it would be desirable to reduce the leakage flow through the core tie linking passages.

The present invention is at least partly based on the recognition that the quantity of cooling air leaking across a core-tie linking passage is a function of the pressure ratio between the upstream and downstream sides of the linking passage, the upstream pressure, and the flow cross-sectional area of the linking passage. One option might, therefore, be to reduce the flow cross-sectional area. However, the physical size of core ties, which is determined by the need to strengthen a core, typically cannot be easily reduced. Also, due to stress field considerations, the position and shape of the core ties cannot easily be changed. Thus, an object of the present invention is to provide a component in which the difference in the static pressure of the cooling fluid between the entrance of a core tie linking passage and the exit of that core tie linking passage is reduced.

Accordingly, a first aspect of the present invention provides a component for the turbine of a gas turbine engine, the component including:

two facing walls interconnected by one or more generally elongate divider members to partially define side-by-side, generally elongate, cooling fluid passage portions which form a multi-pass cooling passage within the component, the passage portions being connected in series fluid flow relationship by respective bends formed by joined ends of neighbouring of the passage portions, and one or more core tie linking passages formed in the divider members, the or each core tie linking passage having an entrance at an upstream passage portion and an exit at a neighbouring downstream passage portion, and allowing cooling fluid to leak therethrough to bypass the bend formed by the joined ends of the neighbouring passage portions, wherein one or more differential pressure reducing arrangements are formed in the multi-pass cooling passage adjacent respective of the core tie linking passages, the or each arrangement reducing the difference in the static pressure of the cooling fluid between the entrance of the respective core tie linking passage and the exit of that core tie linking passage.

By reducing the differential static pressure across the or each linking passage, the leakage flow through the passage can be decreased, leading to reductions in aerodynamic losses, increases in engine efficiency and reduced engine specific fuel consumption.

The component may have any one or, to the extent that they are compatible, any combination of the following optional features.

The or each differential pressure reducing arrangement can include a flow accelerating formation in the upstream passage portion, the flow accelerating formation increasing the velocity of the cooling fluid flow in the upstream passage portion at the entrance of the core tie linking passage. By increasing the velocity of the cooling fluid flow, the static pressure at the entrance of the core tie linking passage can be decreased to reduce the differential pressure across the linking passage.

The flow accelerating formation may include one or more flow splitting members in the upstream passage portion, the or each flow splitting member interconnecting the facing walls and extending in the direction of flow of the cooling fluid to form, on a longitudinal cross-section through the aerofoil portion, an elongate island around which the cooling fluid flow splits in the upstream passage portion. By dividing the flow around the flow splitting member, the flow conditions can be controlled to increase the velocity of the cooling fluid flow at the entrance of the core tie linking passage. For example, the one or more flow splitting members can produce a flow pathway around the member or members distal the entrance of the linking passage, and a flow pathway around the member or members proximal the entrance of the linking passage, the distal flow path having an entry flow cross-sectional area A1 and an exit flow cross-sectional area A3, and the proximal flow path having an entry flow cross-sectional area A2 and an exit flow cross-sectional area A4. By setting $A4/A3<A2/A1$, an increased velocity of the cooling fluid flow at the entrance of the core tie linking passage can be achieved.

Optionally, the flow accelerating formation includes a local reduction in the flow cross-sectional area of the upstream passage portion at the entrance of the core tie linking passage. For example, a local thickening in the divider wall facing the entrance of the core tie linking passage can produce the local reduction in the flow cross-sectional area.

Additionally or alternatively, the or each differential pressure reducing arrangement includes a flow decelerating formation in the downstream passage portion, the flow decelerating formation decreasing the velocity of the cooling fluid flow in the downstream passage portion at the exit of the core tie linking passage. By decreasing the velocity of the cooling fluid flow, the static pressure at the exit from the core tie linking passage can be increased to reduce the differential pressure across the linking passage.

The flow decelerating formation can include one or more flow splitting members in the downstream passage portion, the or each flow splitting member interconnecting the facing walls and extending in the direction of flow of the cooling fluid to form, on a longitudinal cross-section through the aerofoil portion, an elongate island around which the cooling fluid flow splits in the downstream passage portion. Conveniently, where the multi-pass cooling passage has two or more core-tie linking passages, a flow splitting member(s) which serves to increase the velocity of the cooling fluid flow at the entrance of one core tie linking passage can also serve to decrease the velocity of the cooling fluid flow at the exit from another core tie linking passage. Such a configuration may be adopted when the first linking passage's exit is at the entry to a bend formed by the joined ends of neighbouring passage portions and the second linking passage's entrance is at the exit from the bend. The flow splitting member(s) may then extend around the bend.

The flow decelerating formation may include a flow blocking structure in the downstream passage portion at the downstream side of the exit of the core tie linking passage, the flow blocking structure converting the dynamic component of the cooling fluid flow in the downstream passage portion at the exit of the core tie linking passage into an increased static pressure.

The or each differential pressure reducing arrangement may include a flow deflector structure in the upstream passage portion, the flow deflector structure substantially locally removing the dynamic component of the cooling fluid flow in the upstream passage portion at the entrance of the core tie linking passage. For example, the flow deflector structure can form a protected cavity in front of the entrance of the linking passage. Particularly in combination with a flow blocking structure in the downstream passage portion at the downstream side of the exit of the linking passage, such a configuration can help to reduce the differential pressure across the linking passage.

The component may be an aerofoil blade or vane, the two walls being the suction side and the pressure side walls of the aerofoil portion of the blade or vane. Typically, the aerofoil portion extends longitudinally in a radial direction of the engine, the divider walls and the cooling fluid passage portions being generally aligned along the longitudinal direction of the aerofoil portion.

However, multi-pass cooling passages formed using core-ties can also be found in endwall components of gas turbine engines. Thus the component may provide an endwall to the working gas annulus of the engine, one of the two facing walls being the endwall. For example, such a component may be a shroud segment or a vane platform.

A second aspect of the present invention provides gas turbine engine having one or more components according to the previous aspect.

Embodiments of the invention will now be described by way of example with reference to the accompanying drawings in which.

The present invention aims at reducing the cooling flow leakage across core-tie leakage passages by reducing the feed pressure and pressure ratio across these features.

In general, the local pressure differential that drives the flow across the core-tie leakage passages can be reduced by increasing the velocity of the flow in the passage portion at the entrance of (i.e. on the upstream side of) the leakage passage and/or decreasing the velocity of the flow in the passage portion at the exit of (i.e. on the downstream side of) the leakage passage. This is because, provided that the direction of the leakage flow is approximately perpendicular to the mainstream flow direction in the passage portions, the static pressure differential is the driver of the leakage flow. More particularly, the total pressure in the passage portions is comprised of two components, the static pressure and the dynamic pressure. if the dynamic pressure increases at a leakage passage entrance then the static pressure falls to compensate. Conversely, if the dynamic pressure decreases at a leakage passage exit then the static pressure increases.

In order to increase the local velocity in a passage portion at a leakage passage entrance, a flow accelerating formation can be introduced into the passage portion. For example, the formation can be in the form of a reduced cross-sectional flow area of an entire passage portion. However, this increases the velocity across the entire passage portion, and thus changes the pressure drop for the whole multi-pass cooling passage, which can reduce overall cooling air flow rates. Therefore, a preferred option is to incorporate one or more flow splitting members into the passage portion to increase the flow velocity locally at the leakage passage entrance.

Similarly, a flow decelerating formation can be introduced into a passage portion at a leakage passage exit that decreases the flow velocity locally at the exit.

FIGS. 4 to 9 show embodiments of the present invention. Corresponding or similar features in FIGS. 4 to 9 have the same reference numbers.

Figure 1:
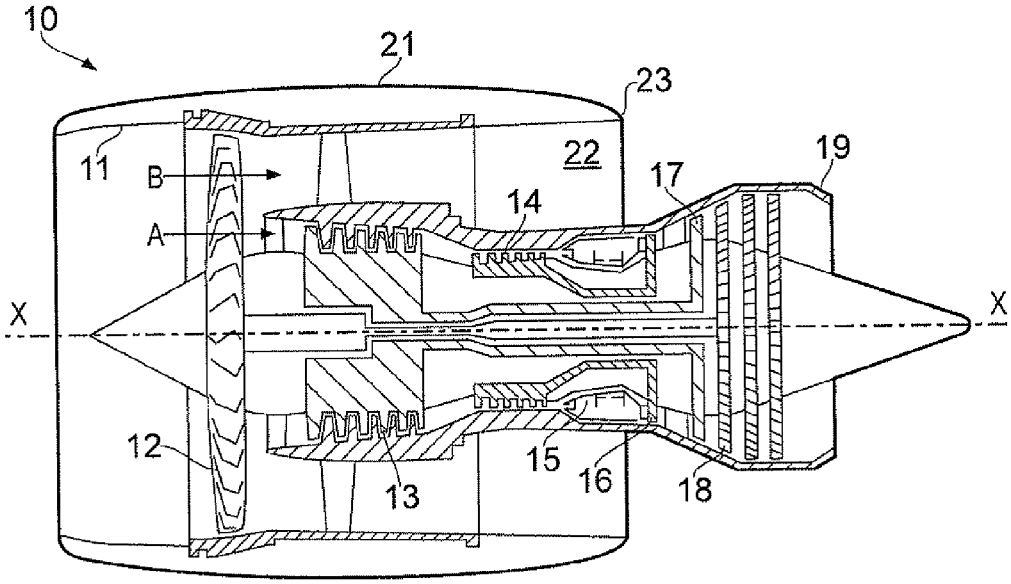
FIG. 1 shows a schematic longitudinal cross-section through a ducted fan gas turbine engine and includes the present invention.
Figure 2:
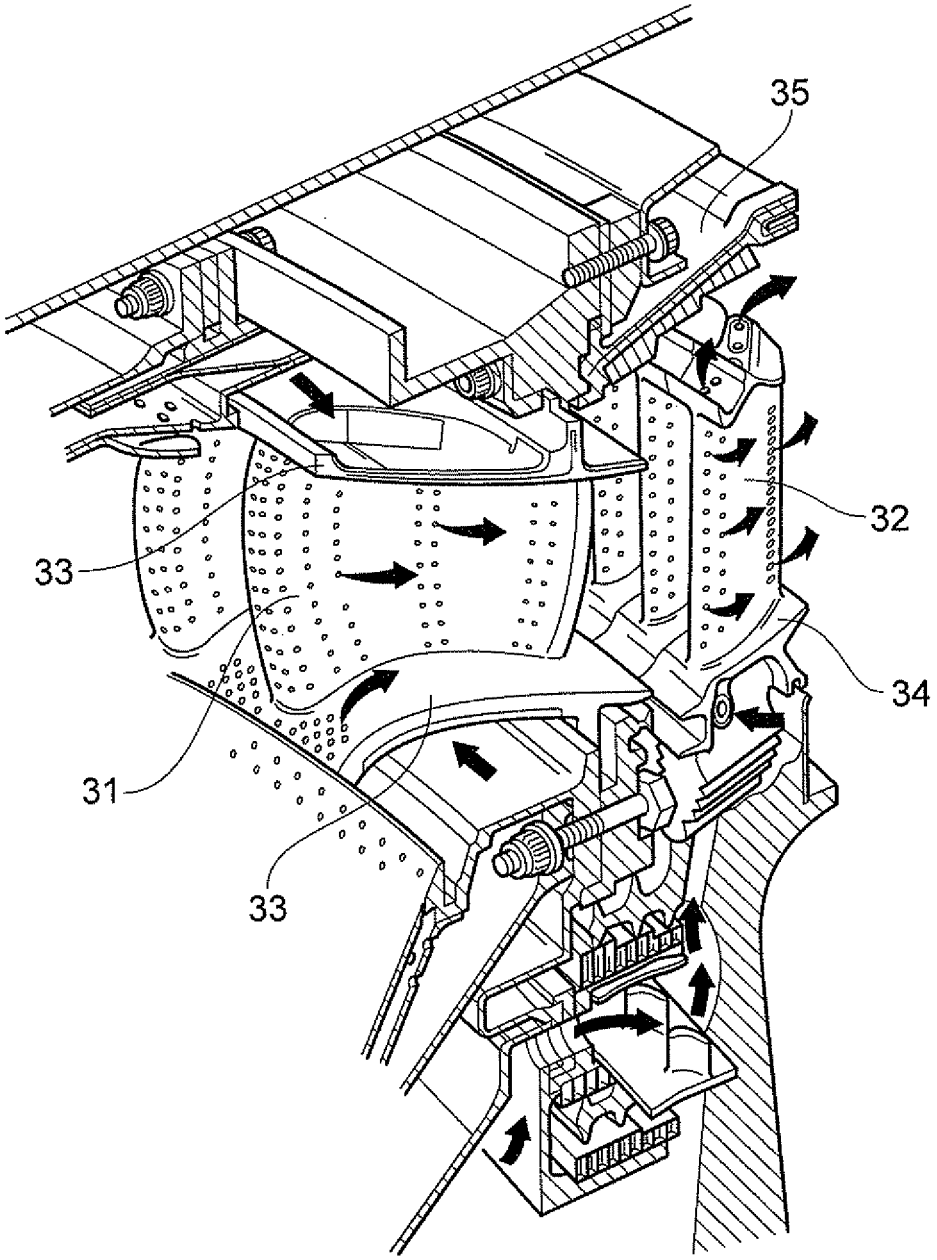
FIG. 2 shows an isometric view of a single stage cooled turbine including the present invention.
Figure 3:
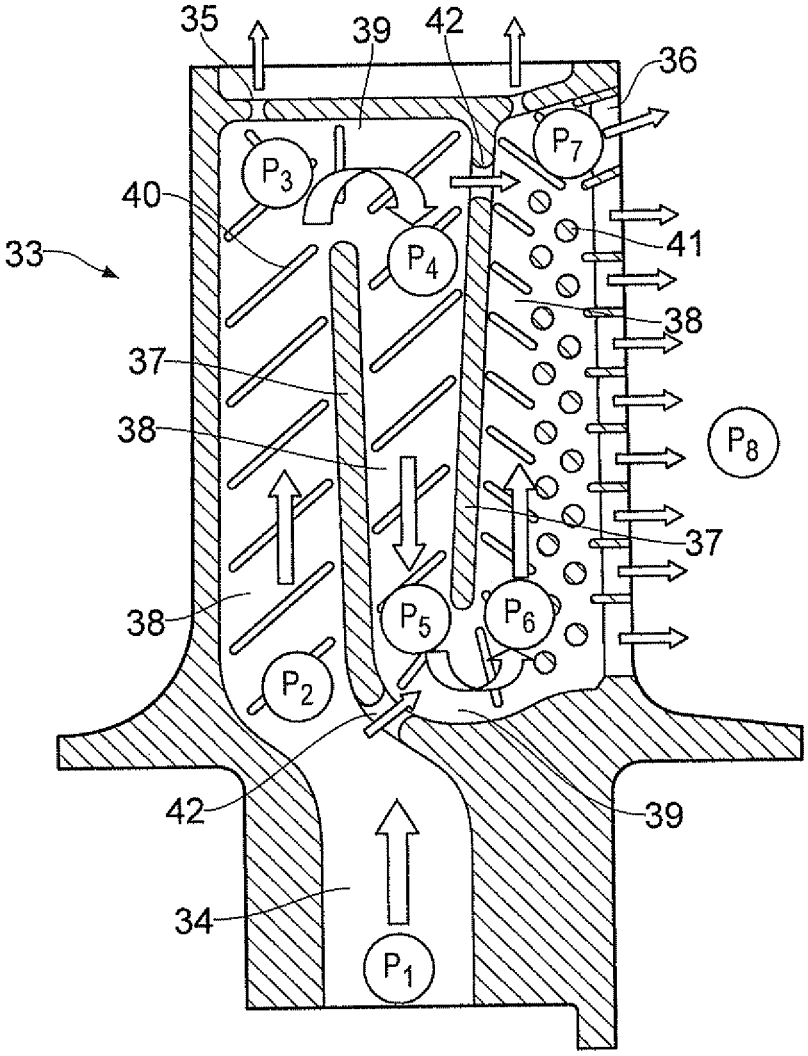
Related Art FIG. 3
FIG. 3 shows a longitudinal cross-section through a high-pressure turbine blade generally known in the related art.
Figure 4:
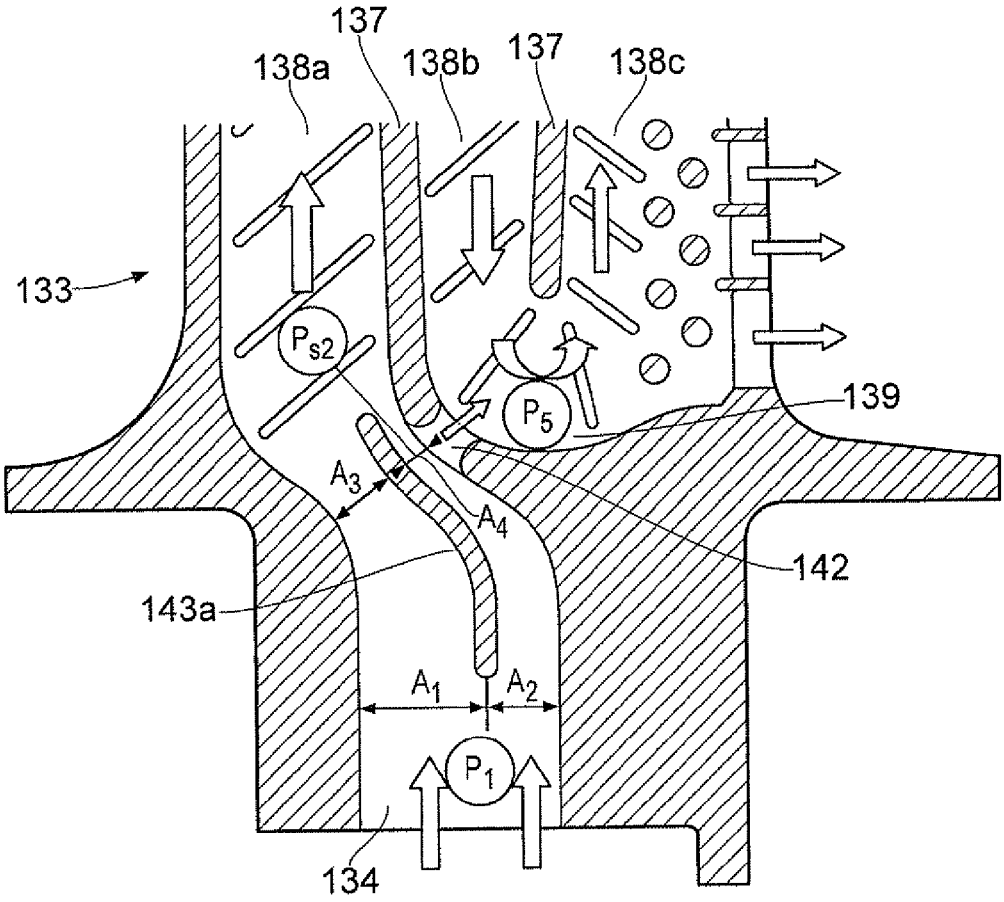
FIG. 4 shows the lower part of a longitudinal cross-section through a high-pressure turbine blade according to a first embodiment of the present invention.

FIG. 4 shows the lower part of a longitudinal cross-section through a high-pressure turbine blade according to a first embodiment of the present invention. An inlet feed passage 134 at the root of the blade directs cooling air to a multi-pass cooling passage 133 formed by three longitudinally extending, side-by-side passage portions 138*a-c*. Two divider walls 137 interconnect the facing suction side and pressure side walls of the aerofoil portion of the blade to partially define the passage portions. 180° bends 139 (only the lower one shown in FIG. 3) formed by the joined ends of neighbouring passage portions connect the passage portions in series fluid flow relationship. The cooling air from inlet feed passage travels first upwards along the passage portion 138*a* at the leading edge of the aerofoil portion, then down the middle passage portion 138*b*, and finally upwards again along passage portion 138*c* at the trailing edge.

A core-tie linking passage 142 extends across the bottom of the divider wall 137 between the leading edge 138*a* and middle 138*b* passage portions, causing some cooling air to bypass the upper bend (not shown) joining these passage portions. To reduce cooling air leakage through the linking passage, a flow splitting member 143*a* is located in the inlet feed passage 134 and extends into the leading edge passage portion adjacent to the linking passage entrance. The flow splitting member interconnects the suction side and pressure side walls and extends in the direction of flow of the cooling air. it thus forms, on the longitudinal cross-section of FIG. 4, an elongate island around which the cooling air flow divides to provide two flow pathways. The flow pathway furthest from the entrance of the linking passage has a mouth flow cross-sectional area denoted A1 in FIG. 4 and an exit cross-sectional area denoted A3. Likewise, the flow pathway closest to the entrance of the linking passage has a mouth flow cross-sectional area denoted A2 and an exit cross-sectional area (in front of the entrance of the linking passage) denoted A4. The relative proportions of the coolant flow passing through the two pathways is a function of the flow areas A1, A2, A3 and A4. By configuring the flow areas such that A4 /A3<A2/A1 the flow is locally accelerated past the entrance to the linking passage.

Thus the local velocity in the leading edge passage portion 138*a* that supplies linking passage 142 can be increased by the positioning of the flow splitting member 143*a* in the feed passage 134 and in the leading edge passage portion. The local static pressure Ps2 at the entrance to the linking passage falls, reducing the pressure level and pressure ratio (Ps2/P5) across the linking passage, and therefore reducing the leakage flow through the linking passage.

The shape of the flow splitting member 143*a* can be as shown in FIG. 4 or can be another smooth shape that accelerates the flow without causing separation.

Figure 5:
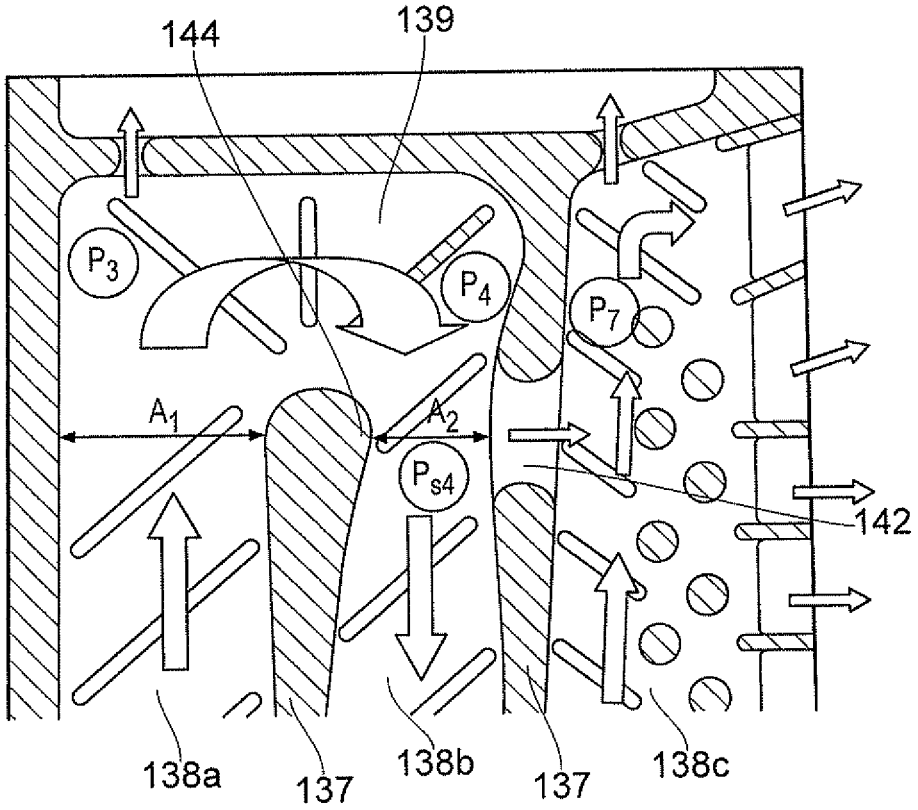
FIG. 5 shows the upper part of a longitudinal cross-section through a high-pressure turbine blade according to a second embodiment of the present invention.

FIG. 5 shows the upper part of a longitudinal cross-section through a high-pressure turbine blade according to a second embodiment of the present invention. In the second embodiment, a core-tie linking passage 142 extends across the top of the divider wall 137 between the middle 138*b* and trailing edge 138*c* passage portions, causing some cooling air to bypass the lower bend (not shown) joining these passage portions.

A flow accelerating formation is provided by a local thickening 144 in the side of the divider wall 137 facing the entrance to the linking passage 142, i.e. the divider wall has an increased radius at its tip forming the inside of the 180° upper bend 139 causing the flow cross-sectional area A1 at the entry of the bend to be greater than the flow area A2 at the exit of the bend. In operation, the coolant flow travels up the leading edge passage portion 138*a* in a radially outward direction, enters the 180° bend and is accelerated in the second half of the bend past the entrance to the linking passage. The local velocity around the bend increases, causing the local static pressure Ps4 at the entrance to the linking passage to fall, reducing the pressure level and pressure ratio (Ps4/P7) across the linking passage, and therefore reducing the leakage flow. The shape of the acceleration feature can be optimised to eliminate any localised flow reversal that may take place close to the inside of the bend.

Figure 6:
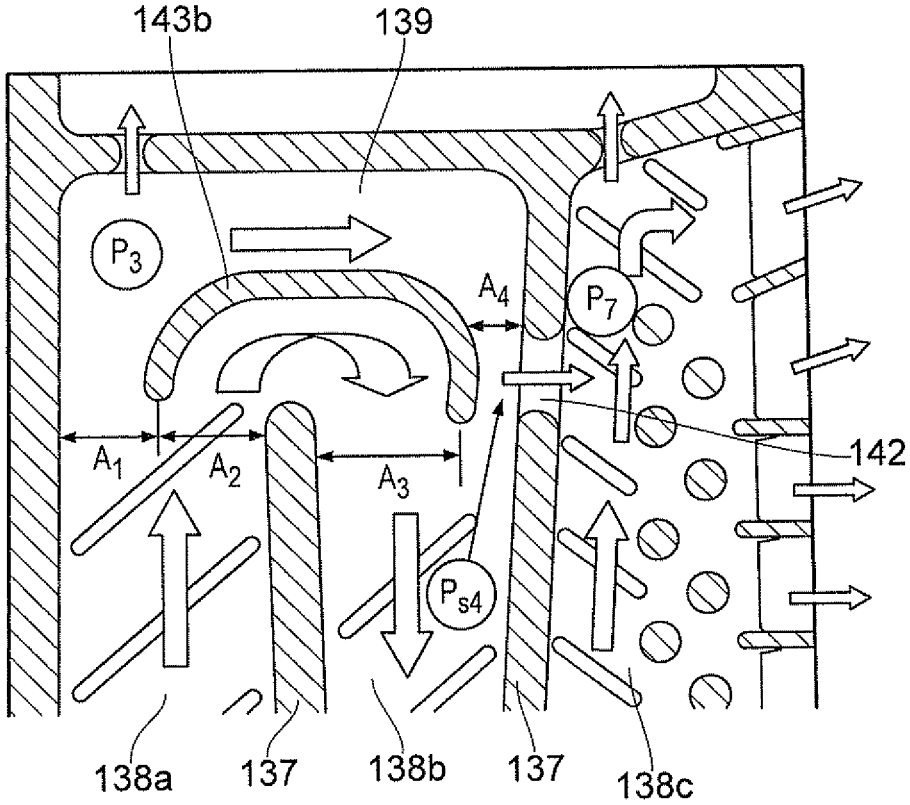
FIG. 6 shows the upper part of a longitudinal cross-section through a high-pressure turbine blade according to a third embodiment of the present invention.

FIG. 6 shows the upper part of a longitudinal cross-section through a high-pressure turbine blade according to a third embodiment of the present invention. In the third embodiment, a core-tie linking passage 142 extends across the top of the divider wall 137 between the middle 138*b* and trailing edge 138*c* passage portions, causing some cooling air to bypass the lower bend (not shown) joining these passage portions.

A flow acceleration formation is provided by flow splitting member 143*b* in the 180° upper bend 139. In operation, the coolant flow travels up the leading edge passage portion 138*a* in a radially outward direction, enters the 180° bend, and divides between two pathways either side of the flow splitting member. By configuring the flow areas of the pathways such that A4/A3<A2/A1 the flow is locally accelerated past the entrance to the linking passage 142. The local static pressure Ps4 at the entrance falls, reducing the pressure level and pressure ratio (Ps4/P7) across the linking passage, and therefore reducing the leakage flow.

Figure 7:
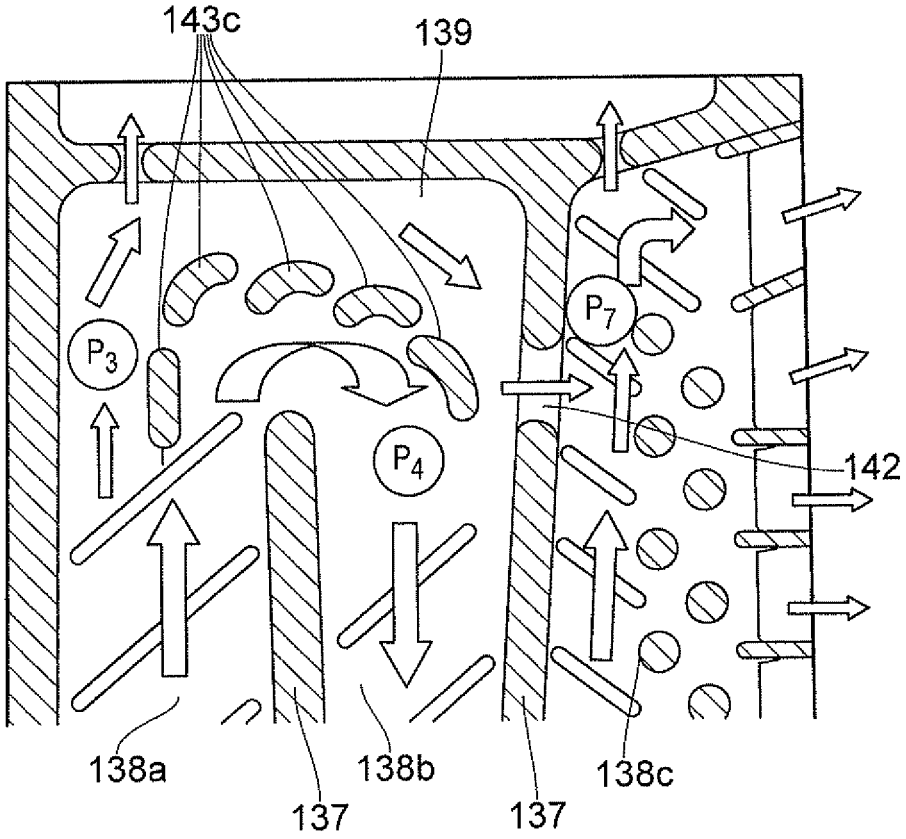
FIG. 7 shows the upper part of a longitudinal cross-section through a high-pressure turbine blade according to a variant of the third embodiment of the present invention.

In order to allow flow and airborne dirt to migrate from the inner pathway around the bend 193 to the outer pathway the flow splitting member can be segmented into overlapping smaller flow splitting members 143*c*, as shown in FIG. 7, which shows the upper part of a longitudinal cross-section through a high-pressure turbine blade according to a variant of the third embodiment of the present invention.

Figure 8:
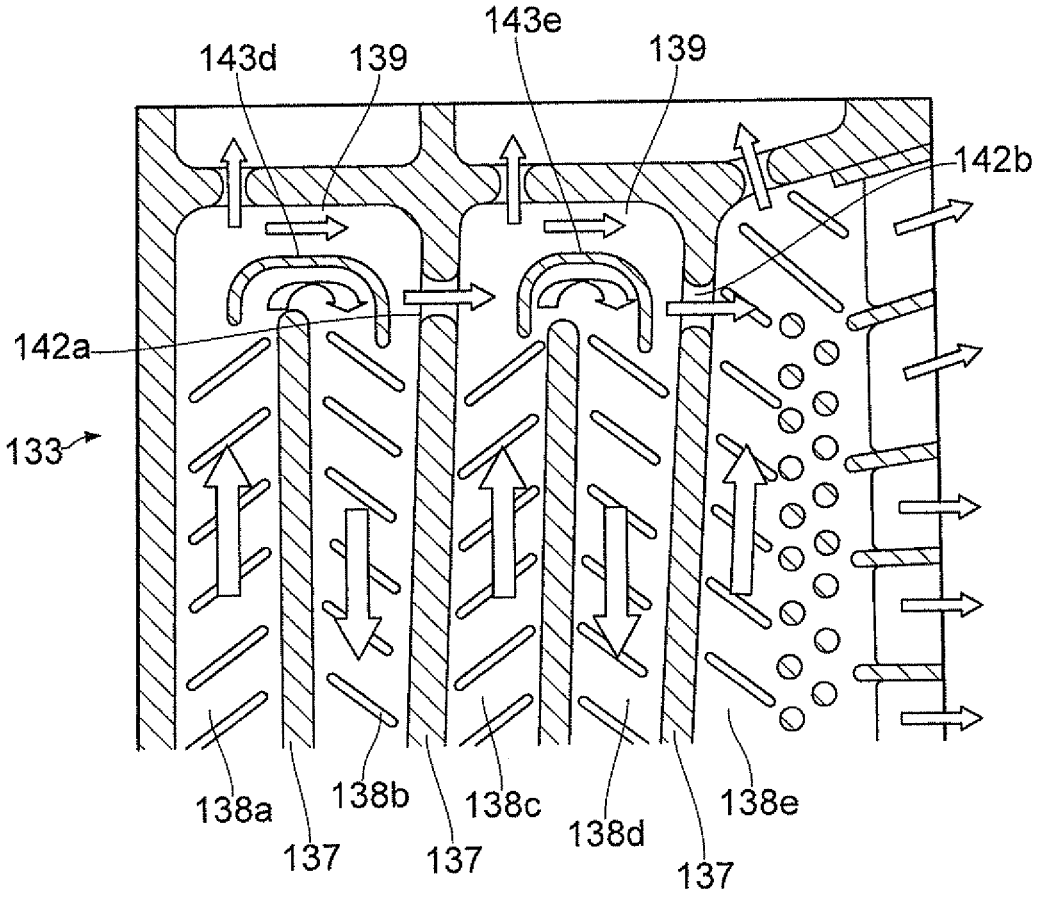
FIG. 8 shows the upper part of a longitudinal cross-section through a high-pressure turbine blade according to a fourth embodiment of the present invention.

FIG. 8 shows the upper part of a longitudinal cross-section through a high-pressure turbine blade according to a fourth embodiment of the present invention. In the fourth embodiment, the multi-pass cooling passage 133 is formed by five longitudinally extending, side-by-side passage portions 138*a-e*. A core-tie linking passage 142*a* extends across the top of the divider wall 137 between the second 138*b* and third 138*c* passage portions, causing some cooling air to bypass a first lower bend (not shown) joining these passage portions. Another core-tie linking passage 142*b* extends across the top of the divider wall between the fourth 138*d* and trailing edge 138*e* passage portions, causing some cooling air to bypass a second lower bend (not shown) joining these passage portions.

Flow acceleration formations are provided by a first flow splitting member 143*d* in the first 180° upper bend 139*a* (joining the leading edge 138*a* and second 138*b* passage portions), and a second flow splitting member 143*e* in the second 180° upper bend 139*b* (joining the third 138*c* and fourth 138*d* passage portions). The flow splitting member are configured in a similar way to the flow splitting member 143*b* of the third embodiment of FIG. 6 in order to reduce the local static pressure at the entrances of the linking passages 142, and therefore reduce the leakage flows.

However, at the exit of the linking passage 142*a* between the second 138*b* and third 138*c* passage portions, the second flow splitting member 143*e* has the added benefit of increasing the local static pressure by virtue of decreasing the local velocity. Thus this flow splitting member further reduces the leakage flow through the linking passage 142*a* as well as reducing the leakage flow through the linking passage 142*b*.

Figure 9:
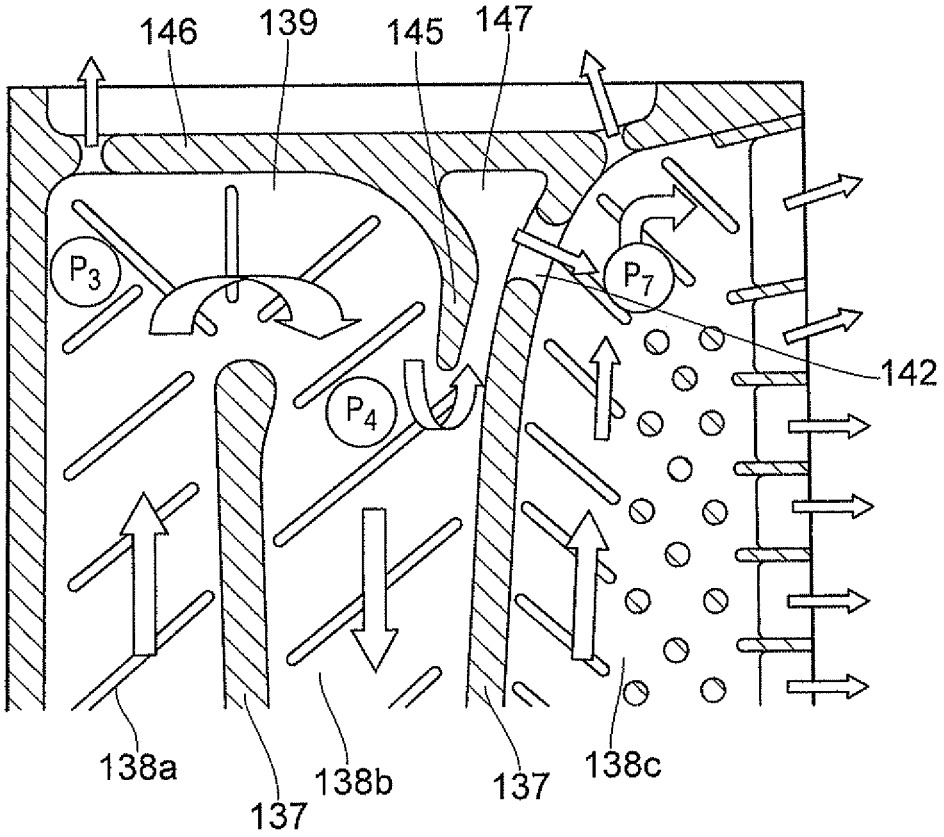
FIG. 9 shows the upper part of a longitudinal cross-section through a high-pressure turbine blade according to a fifth embodiment of the present invention.

FIG. 9 shows the upper part of a longitudinal cross-section through a high-pressure turbine blade according to a fifth embodiment of the present invention. In the fifth embodiment, a core-tie linking passage 142 extends across the top of the divider wall 137 between the middle 138*b* and trailing edge 138*c* passage portions, causing some cooling air to bypass the lower bend (not shown) joining these passage portions.

In operation, coolant flow travels up the leading edge passage portion 138*a* in a radially outward direction, enters 180° upper bend 139, and then travels down middle passage portion 138*b*. A flow deflector structure 145 extends from an outer wall 146 of the aerofoil portion across the entrance to the linking passage 142. The shape and location of the flow deflector structure creates a cavity 147 in front of the entrance.

Any coolant flow that enters the cavity 147 has to negotiate a tight 180° bend. This helps to ensure that most of the dynamic component of the total pressure is lost and the static pressure of the coolant becomes the feed pressure to the linking passage 142. A flow blocking structure, such a pedestal or pin fin, can be incorporated into the entry to the cavity to further reduce the feed pressure. At the exit from the linking passage 142, the local static pressure can be increased by providing a further flow blocking structure, such as a rib or trip strip, at the downstream side of the exit. Indeed, the further flow blocking structure could take the form of structure extending from the outer wall 146 across the exit to the linking passage in the manner of a mirror image to the flow deflector structure 145. Such a structure would form a cavity in front of the exit that would trap the oncoming coolant flow, locally converting its dynamic pressure into an increased static pressure.

Core-Tie features are incorporated into multi-pass cooling arrangements to provide a link In summary, the present invention provides a means of reducing the quantity of coolant air leaking across a core-tie linking passages by changing the local feed pressure, and pressure ratio, experienced by the linking passages. The local pressure is at the entrance to a core-tie linking passage can be increased by accelerating the flow using a geometric feature positioned in the upstream passage portion. Similarly, the local pressure downstream of the linking passage can be increased by decelerating the flow using a geometric feature positioned in the downstream passage portion. The reduced leakage flow has a beneficial effect on cooling efficiency, which leads to an decreased cooling requirement and associated reduction in aerodynamic mixing losses.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A component for a turbine of a gas turbine engine, the component comprising:

two facing walls interconnected by one or more generally elongate divider members to partially define side-by-side and generally elongate cooling fluid passage portions forming a multi-pass cooling passage within the component, the passage portions being connected in a series fluid flow relationship by respective bends formed by joined ends of neighboring cooling fluid passage portions;

one or more core tie linking passages formed in the divider members, and at least one core tie linking passage having an entrance at an upstream passage portion and an exit at a neighboring downstream passage portion to allow cooling fluid to leak therethrough to bypass the bend formed by the joined ends of the neighboring passage portions; and one or more differential pressure reducing arrangements formed in the multi-pass cooling passage facing a respective one of the core tie linking passages and the one or more differential pressure reducing arrangements extending at least partially across the entrance of the one of the core tie linking passages, the one or more differential pressure reducing arrangements being configured to reduce the difference in the static pressure of the cooling fluid between the entrance of the respective core tie linking passage and the exit of the core tie linking passage, the one or more differential pressure reducing arrangements including a flow deflector structure in the upstream passage portion, and the flow deflector structure being configured to substantially locally remove a dynamic component of the cooling fluid flow in the upstream passage portion at the entrance of the core tie linking passage, wherein:

the flow deflector structure defines a cavity in the upstream passage portion at the entrance of the core tie linking passage, and the flow deflector structure is configured to define a one hundred and eighty degree bend for flow of coolant air from the upstream passage portion to the cavity.

2. The component according to claim 1, further comprising:

a flow decelerating formation in the downstream passage portion, the flow decelerating formation being arranged to decrease the velocity of the cooling fluid flow in the downstream passage portion at the exit of the core tie linking passage.

3. The component according to claim 2, wherein the flow decelerating formation includes one or more flow splitting members in the downstream passage portion, the one or more flow splitting members interconnecting the facing walls and extending in the direction of flow of the cooling fluid to form, on a longitudinal cross-section through the aerofoil portion, an elongate island around which the cooling fluid flow splits in the downstream passage portion.

4. The component according to claim 3, wherein the flow decelerating formation includes a flow blocking structure in the downstream passage portion at the downstream side of the exit of the core tie linking passage, the flow blocking structure being arranged to convert the dynamic component of the cooling fluid flow in the downstream passage portion at the exit of the core tie linking passage into an increased static pressure.

5. The component according to claim 2, wherein the flow decelerating formation includes a flow blocking structure in the downstream passage portion at the downstream side of the exit of the core tie linking passage, the flow blocking structure being arranged to convert the dynamic component of the cooling fluid flow in the downstream passage portion at the exit of the core tie linking passage into an increased static pressure.

6. The component according to claim 1, which is an aerofoil blade or vane, the two facing walls being the suction side and the pressure side walls of the aerofoil portion of the blade or vane.

7. A gas turbine engine having one or more components according to claim 1.

* * * * *